US011608945B1

(12) United States Patent
Hwang

(10) Patent No.: US 11,608,945 B1
(45) Date of Patent: Mar. 21, 2023

(54) FAN-SHAPED FLASHLIGHT WITH ADJUSTING LIGHTING ANGLE

(71) Applicant: METROMAX AMERICA CORPORATION, Rowland Heights, CA (US)

(72) Inventor: Christina Hwang, Rowland Heights, CA (US)

(73) Assignee: METROMAX AMERICA CORPORATION, Rowland Heights, CA (US)

( * ) Notice: Subject to any disclaimer, the term of this patent is extended or adjusted under 35 U.S.C. 154(b) by 0 days.

(21) Appl. No.: 17/885,675

(22) Filed: Aug. 11, 2022

(51) Int. Cl.

| | |
|---|---|
| ***F21L 4/00*** | (2006.01) |
| ***F21V 23/06*** | (2006.01) |
| ***F21L 4/02*** | (2006.01) |
| ***F21S 9/02*** | (2006.01) |

(52) U.S. Cl.
CPC ..... *F21L 4/005* (2013.01); *F21L 4/027* (2013.01); *F21S 9/02* (2013.01); *F21V 23/06* (2013.01)

(58) Field of Classification Search
CPC ..... F21L 4/00; F21L 4/005; F21L 4/02; F21L 4/022; F21L 4/027; F21L 4/04; F21L 4/08; F21L 4/085; F21L 4/045; F21V 23/06; F21V 14/06; F21V 14/065; F21V 21/145; F21V 21/30; F21S 9/02
See application file for complete search history.

(56) References Cited

U.S. PATENT DOCUMENTS

| | | | | |
|---|---|---|---|---|
| 10,001,252 | B2 | 6/2018 | Inskeep | |
| 10,393,326 | B2 | 8/2019 | Inskeep | |
| 10,539,306 | B1 | 1/2020 | Hwang | |
| 10,605,418 | B2 | 3/2020 | Chen et al. | |
| 2013/0308308 | A1* | 11/2013 | Pritchett | F21L 4/005 362/184 |
| 2014/0321107 | A1* | 10/2014 | Namors | F21L 4/027 362/184 |
| 2017/0184293 | A1* | 6/2017 | Chen | F21V 21/30 |
| 2021/0388953 | A1* | 12/2021 | McGovern, Jr. | F21L 4/027 |

* cited by examiner

*Primary Examiner* — Y M. Quach Lee
(74) *Attorney, Agent, or Firm* — Bacon & Thomas, PLLC

(57) ABSTRACT

A fan-shaped flashlight with adjustable lighting angle includes a connection seat disposed at the front end of a handle, a front-projection primary light installed at the front end of the connection seat, and two left-front and right-front projection secondary lights pivoted to two sides of the primary light respectively. The primary light and two secondary lights are arranged side-by-side on the same plane to project light within a fan-shaped angle, and the two secondary lights can be turned separately towards the outside relative to the primary light to adjust their lighting angle and position.

8 Claims, 7 Drawing Sheets

FAN-SHAPED FLASHLIGHT WITH ADJUSTING LIGHTING ANGLE

FIELD OF THE INVENTION

The present disclosure relates to a hand-held lighting tool, and more particularly to a flashlight with a primary light and two secondary lights which are arranged side by side on a same plane to project light within a substantially fan-shaped angle, and the two secondary lights can be reflected relative to the primary light in order to adjust the lighting angle and position.

BACKGROUND OF THE INVENTION

Flashlight is a kind of hand-held lighting tool, and its structure includes a battery installed in a light housing which is provided for a user's grip, an LED installed at the front end of the light housing and electrically connected to the battery, and a bowl-shaped reflector disposed around the outer periphery of the LED. The light emitted from the LED passes through to the bowl-shaped reflector to produce a light focusing effect, so that the flashlight can cast light towards the front.

The traditional flashlights usually come with a single lighting direction and a limited lighting distance and range only and thus fail to meet different using requirements. For example, when a user needs to cast light on a specific target object in the left front direction or the right front direction, the user's hand that holds the flashlight and the user's body must be turned into a desired direction to cast the light on the target.

When the user needs to cast light on a target object on the left front and right front at the same time, the user must move back and forth between the left front and right sides to adjust the lighting direction of the flashlight in order to see the target objects on the left front and right front sides clearly.

Due to the limited function of traditional flashlights, many flashlights with adjustable range or focal length of lighting come with a design as disclosed in U.S. Pat. No. 10,605,418 that allows users to adjust the focal length of lighting in a telescopic manner to provide different lighting distances. For example, a light focusing method is used to project light to a farther distance, and thus the lighting range of the surrounding becomes relatively smaller. On the other hand, if the lighting range of the surrounding is increased, the light can only be projected at a short distance. However, this function of adjusting the focal length of lighting still cannot illuminate a plurality of target objects in different directions at the same time.

As disclosed in U.S. Pat. Nos. 10,001,252 and 10,393,326, a light head is installed at a front end of a handle, and a plurality of light panels is installed around the light head, and the plurality of light panels can be folded and leaned against the periphery of the handle. During operation, users can spread the plurality of light panels in an umbrella-like form relative to the light head in order to expand the lighting range. However, the function of the light panels is to supplement light in a large range around the light head only, but it cannot focus lighting for illumination as the light head, and the overall operation of the light panels consumes much power.

As disclosed in U.S. Publication No. 20100039801A1, three light heads arranged into a ring shape are pivotally installed at a front end of a handle, and the three light heads can project light towards the front simultaneously, or can be turned and spread open by using the handle as an axis to project lights towards the top side or bottom side on different planes. Although US20100039801A1 can project light in many different directions simultaneously, these directions are different from the user's line of sight to the front. Even if the user can project light to the front by one of the light heads and turn the other two light heads, but the other two light heads do not project light to the left front or the right front and they only project light towards the sky or the ground provided that the light head facing the front is used as the center point, and this is not in line with the users' habit of using flashlight and projecting lights to the front or the left front and the right front.

This discloser once filed a patent application which was granted with U.S. patent Ser. No. 10/539,306 entitled "DOUBLE LAMPSHADE TABLE LAMP", characterized in that two lampshades are arranged side by side on a lamp arm, and the two lampshades can be fanned out to expand the lighting area. Under the influence of the use of the flashlight's intuitive forward lighting, the application of the fan-shaped structure to the flashlight will help to improve the shortcomings of the limited lighting range of the traditional flashlight.

In view of the aforementioned drawbacks of the prior art, the inventor of the present invention based on years of experience in the related industry to conduct extensive research and experiment, and finally developed a cold/hot compress strip to overcome the problems of

SUMMARY OF THE INVENTION

Specifically, this disclosure is directed to a fan-shaped flashlight with adjustable lighting angle, comprising: a handle, provided for a user's grip, and having a front end, and a battery installed in the handle; a connection seat, fixed to the front end of the handle, and having a top side, a front end configured to be facing the front, and two side ends disposed on two sides of the connection seat respectively, and the connection seat comprising a circuit board installed therein and electrically coupled to the battery, and a switch installed at the top side of the connection seat and electrically coupled to the circuit board; a primary light, installed at the front end of the connection seat, and supplied with electric power by the circuit board to project light towards the front; two secondary lights pivoted to two side ends of the connection seat respectively, configured to be opposite to two sides of the primary light respectively, and supplied with electric power by the circuit board to project light towards the left front and the right front respectively; wherein the primary light and the two secondary lights are arranged side by side on a same plane to project light within a fan-shaped angle, and the two secondary lights can be turned on the same plane and spread towards the outside relative to the primary light to adjust the lighting angle and position.

Compared to the traditional flashlights with only a single lighting direction and a limited lighting distance and range, the flashlight of this disclosure has a primary light and two secondary lights arranged side by side on a same plane to project light within a fan-shaped angle to provide a greater lighting range; and the two secondary lights can be turned outwardly on the same plane and spread open to adjust the lighting angle and position, so as to allow users to watch the front and left and right two sides at the same time, and this disclosure adopts an intuitive way of operation, so that the users can operate the handle to adjust the lighting direction of the primary light, while watching the two sides of the lighting range of the primary light to achieve simultaneous lighting functions in different directions.

In an embodiment of this disclosure, the primary light and the two secondary lights come with the structure of LEDs and reflectors of that can concentrate the lighting instead of supplementing light in a large scale as in the traditional technology, so that it can save electric power. In addition, the primary light can be designed with the function of adjusting the focal length of the lighting, so that when the light is projected at a farther distance, the light can be projected at a closer distance with the secondary lights on the two sides to view the surrounding as well as farther position clearly. Obviously, this disclosure is more convenient to use.

The technical characteristics of the present invention will become apparent with the detailed description of preferred embodiments accompanied with the illustration of related drawings.

DESCRIPTION OF THE PREFERRED EMBODIMENTS

Figure 1:
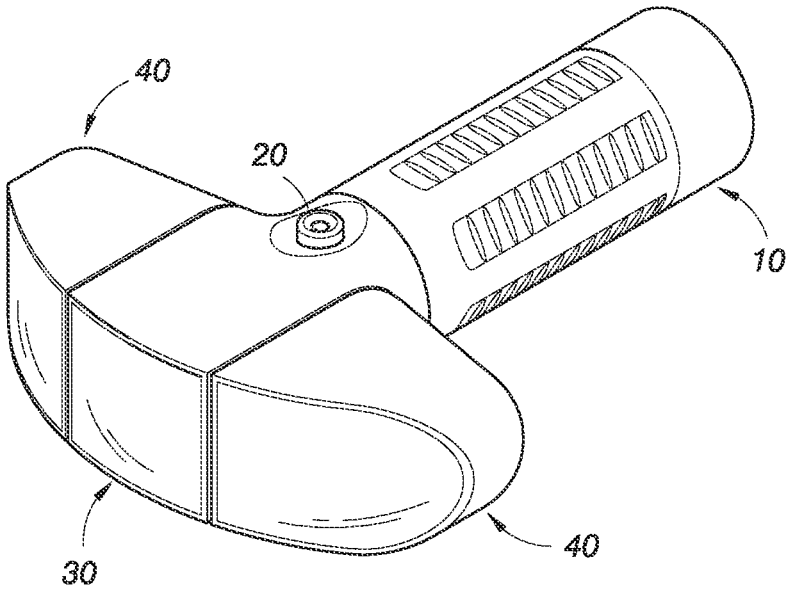
FIG. 1 is a perspective view of the present invention.

With reference to FIGS. 1 to 4 for a fan-shaped flashlight with adjustable lighting angle in accordance with this disclosure, the fan-shaped flashlight with adjustable lighting angle includes a handle 10, a connection seat 20, a primary light 30, and two secondary lights 40.

The handle 10 is provided for a user's grip, and the handle 10 has a front end 101 and a battery 50 installed in the handle 10.

The connection seat 20 is fixed to the front end 101 of the handle 10, and the connection seat 20 has a top side 201, a front end 202 facing the front, and two side ends 203 disposed on left and right sides, and the connection seat 20 has a circuit board 51 installed in the connection seat 20 and electrically connected to the battery 50, and the top side 201 of the connection seat 20 has a switch 52 electrically connected to the circuit board 51.

The primary light 30 is installed at the front end 202 of the connection seat 20, and supplied with electric power by the circuit board 51 to project light towards the front.

The two secondary lights 40 are pivoted to two side ends 203 of the connection seat 20 respectively, configured to be opposite to two sides of the primary light 30 respectively, and supplied with electric power by the circuit board 51 to project light towards the front.

Figure 3:
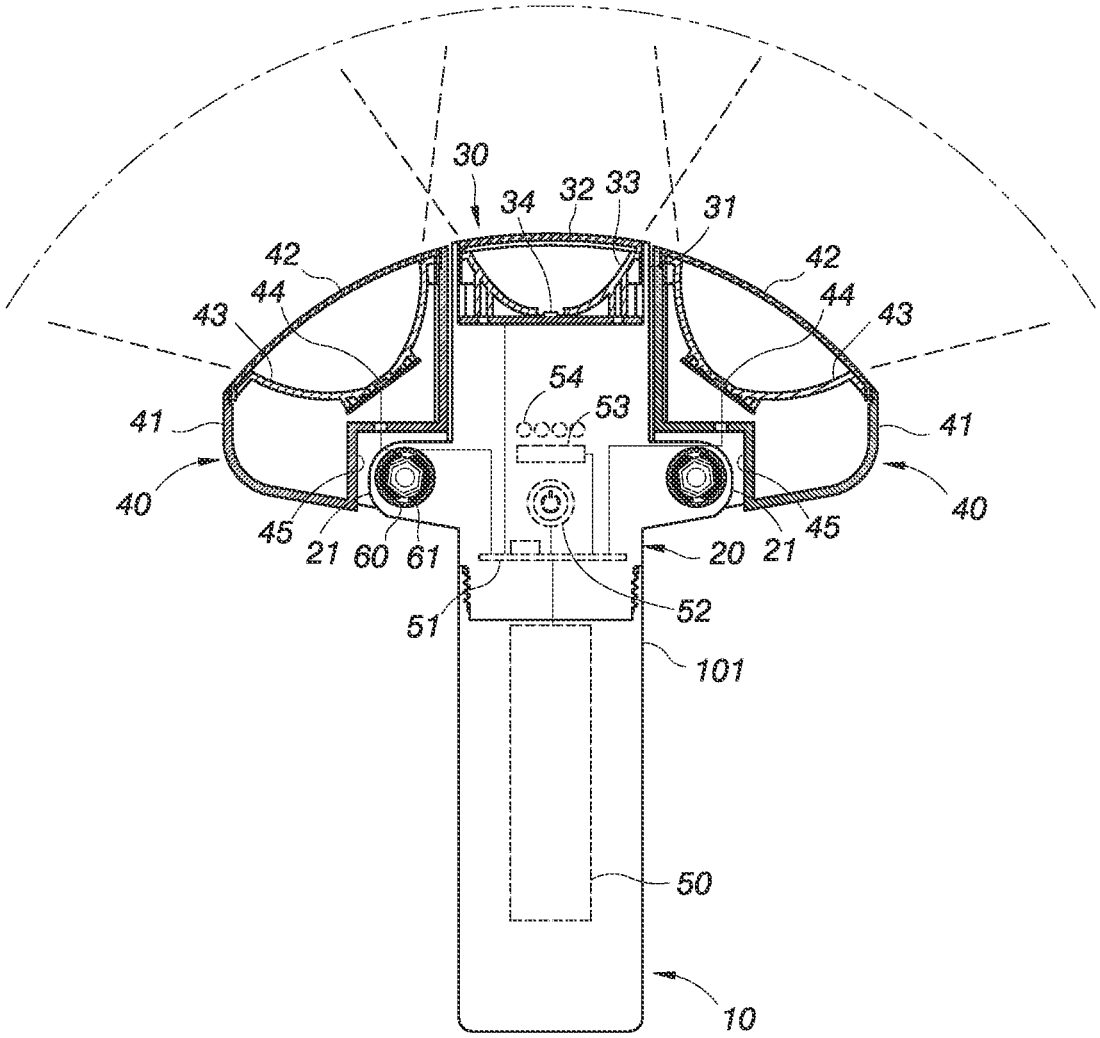
FIG. 3 is a schematic view of projecting light within a fan-shaped angle in accordance with the present invention e.
Figure 4:
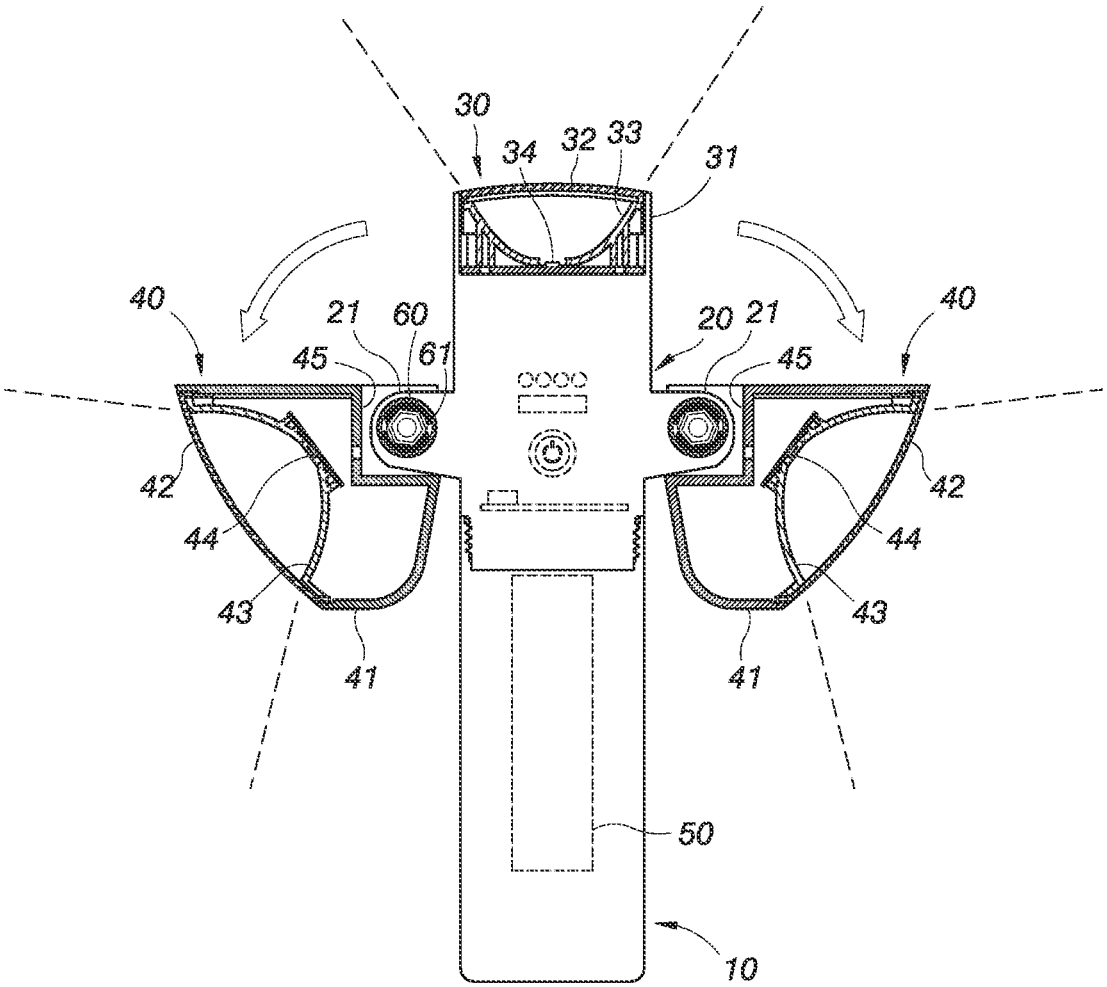
FIG. 4 a schematic view of turning the two secondary lights separately and outwardly relative to the primary light and spreading them open in accordance with the present invention.

In FIGS. 3 and 4, the primary light 30 and the two secondary lights 40 are arranged side by side on a same plane, and after the user turns on the switch 52, the primary light 30 and the two secondary lights 40 can project light within a fan-shaped angle. Compared to the traditional flashlight, this disclosure provides a greater lighting area, and the two secondary lights 40 can be outwardly turned on the same plane relative to the primary light 30 and spread open to adjust the lighting angle and position of the two secondary lights 40, and allow the user to view the conditions in the front and on both left and right sides simultaneously.

This disclosure still adopts an intuitive using method, of which the primary light 30 projects light towards the front and allows the user to operate the handle 10 to adjust the lighting direction of the primary light 30, while seeing the illumination om two sides of the lighting range of the primary light 30 to achieve the function of illuminating many different directions simultaneously, especially the aforementioned two secondary lights 40 can be separately turned and adjusted to the outside relative to the primary light 30, so as to illuminate a plurality of target objects at different positions simultaneously, and the two secondary lights 40 can be turned outwards and spread open on the same plane, which is in line with the usage habit of flashlight that faces the front or the left and right fronts of the user's line of sight.

Figure 2:
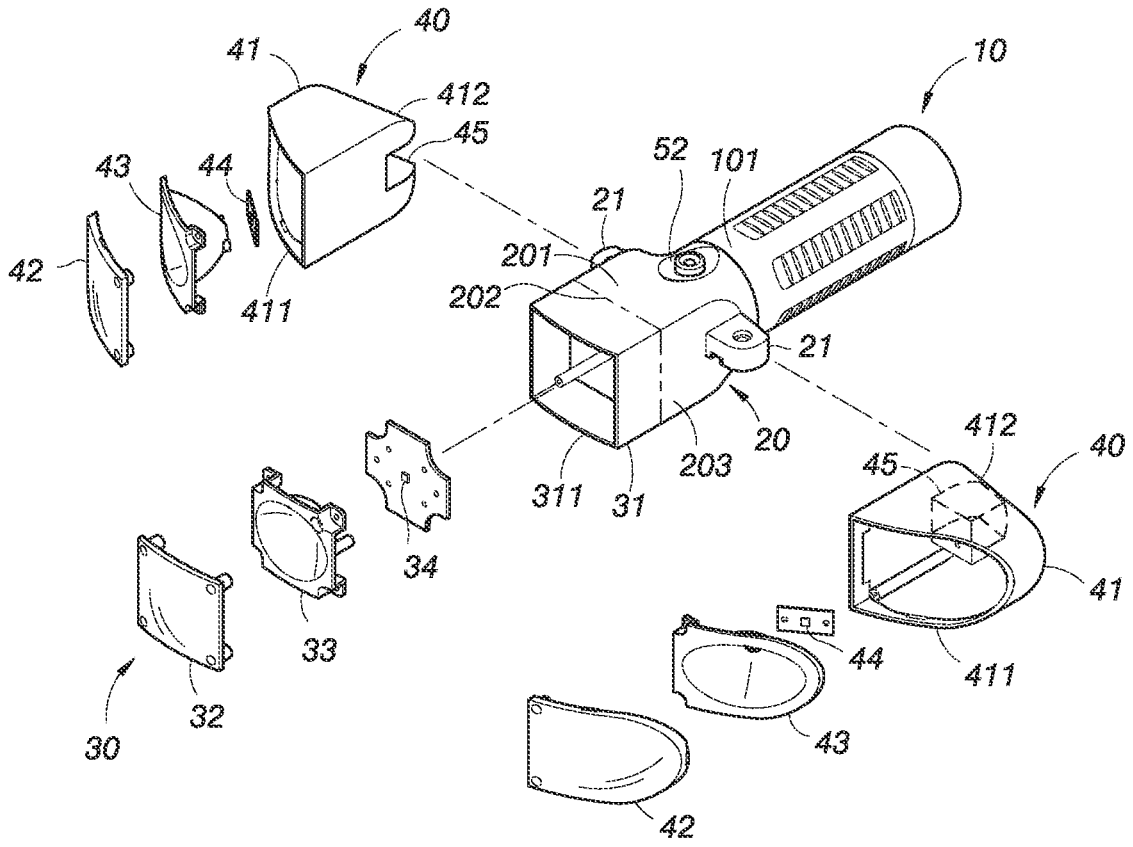
FIG. 2 is an exploded view of the present invention.

In an embodiment as shown in FIGS. 2-4, the primary light 30 includes a first lamp housing 31 connected with the connection seat 20; the first lamp housing 31 has a front edge 311 facing the front; the front edge 311 of the first lamp housing 31 has a first light-transmitting plate 32; and the first lamp housing 31 includes a first reflector 33 installed in the first lamp housing 31, and a first LED 34 electrically connected with the circuit board 51; and the first LED 34 emits light which is projected towards the front through the first reflector 33 and first light-transmitting plate 32.

In an embodiment, the two secondary lights 40 separately includes a second lamp housing 41 pivotally connected with the connection seat 20; the second lamp housing 41 has a front edge 411 facing the left front or the right front; the front edge 411 of the second lamp housing 41 is provided with a second light-transmitting plate 42, and a second reflector 43 is installed in the second lamp housing 41, and the circuit board 51 is electrically connected to a second LED 44.

The two second reflectors 43 and the two second LEDs 44 are arranged at an inclined angle toward the left front and the right front respectively with respect to the first LED 34 to allow the light emitted by the two second LEDs 44 to pass through the corresponding second reflector 43 and second light-transmitting plate 42 and then project towards the left front and the right front respectively, so that the a primary light 30 and two secondary lights 40 arranged on the same plane can cast light within a fan-shaped angle.

In this disclosure, the primary light 30 and the secondary lights 40 have an LED light source and a reflector structure. In an embodiment, a lighting of 2 W/200 lumens can be adopted to focus the lighting instead of supplementing light in a large range as in the related art, and thus this disclosure has the advantage of saving electric power.

In an embodiment, the first light-transmitting plate 32 is designed with an outer contour in an arc-shape, and the second light-transmitting plate 42 is also designed with an outer contour in an arc-shape and arranged with an angle inclined towards the left front relative to the first light-transmitting plate 32, and the other second light-transmitting plate 42 is designed with an angle inclined towards the right front relative to the first light-transmitting plate 32, and the first light-transmitting plate 32 and the two second light-transmitting plates 42 are combined into a continuous arc shape to allow the two second LEDs 44 arranged with an inclined angle to project light without being blocked by the edge of the second lamp housing 41.

In addition, the two secondary lights 40 can be separately turned towards the outside by approximately 90 degrees relative to the primary light 30. In order to allow the two secondary lights 40 to be positioned after being turned, each of the two second lamp housings 41 has a rear end 412 facing the rear, and provided with a hinge slot 45, and two side ends 203 of the connection seat 20 are respectively provided with a protruding a hinge lug 21 corresponding to the two hinge slots 45, The two hinge lugs 21 are pivoted in the corresponding hinge slots 45 respectively.

A plurality of positioning recesses 60 is respectively provided between the two hinge slots 45 of the two second lamp housings 41 and the two hinge lugs 21 of the connection seat 20, and at least an elastic protrusion 61 is provided relative to the plurality of positioning recesses 60. After the two second lamp housings 41 are turned relative to the connection seat 20, the elastic protrusion 61 can be snapped in any one positioning recess 60 and positioned, and such arrangement not only prevents the secondary light 40 from shaking after being turned, but also produces a hand feel of a multi-stage snap during operation.

Figure 5:
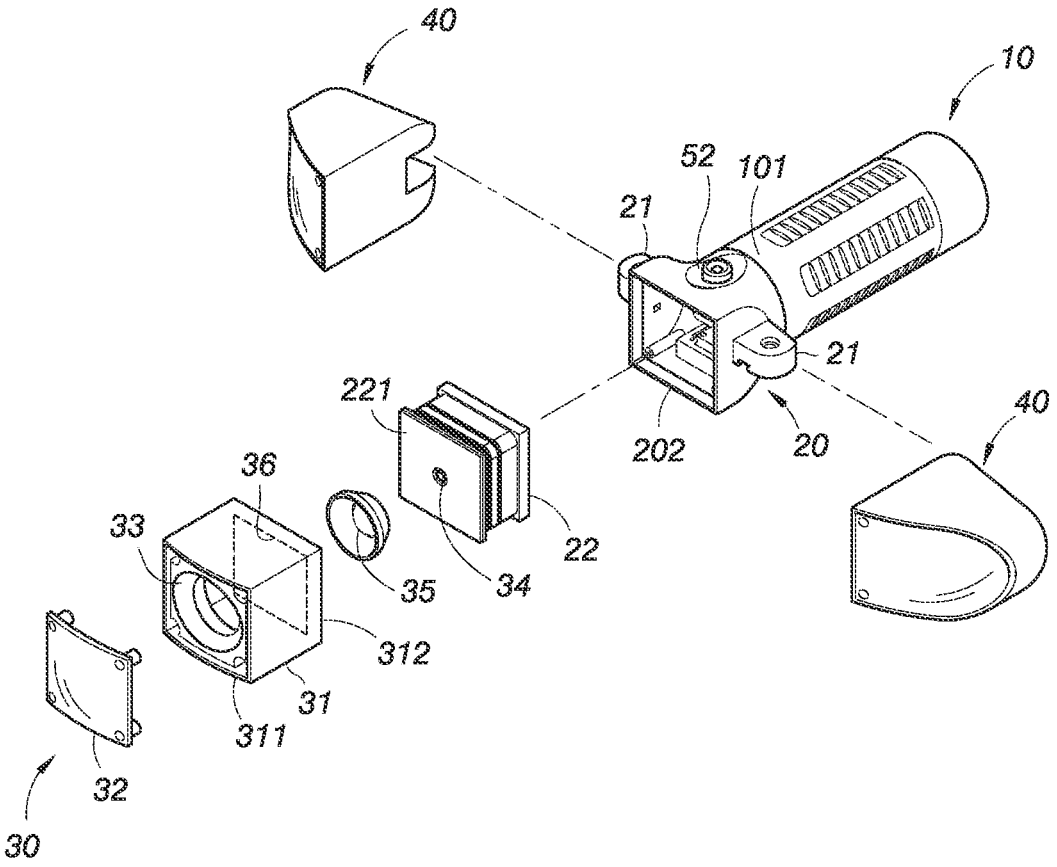
FIG. 5 is an exploded view of a primary light in accordance with a second embodiment of the present invention.
Figure 6:
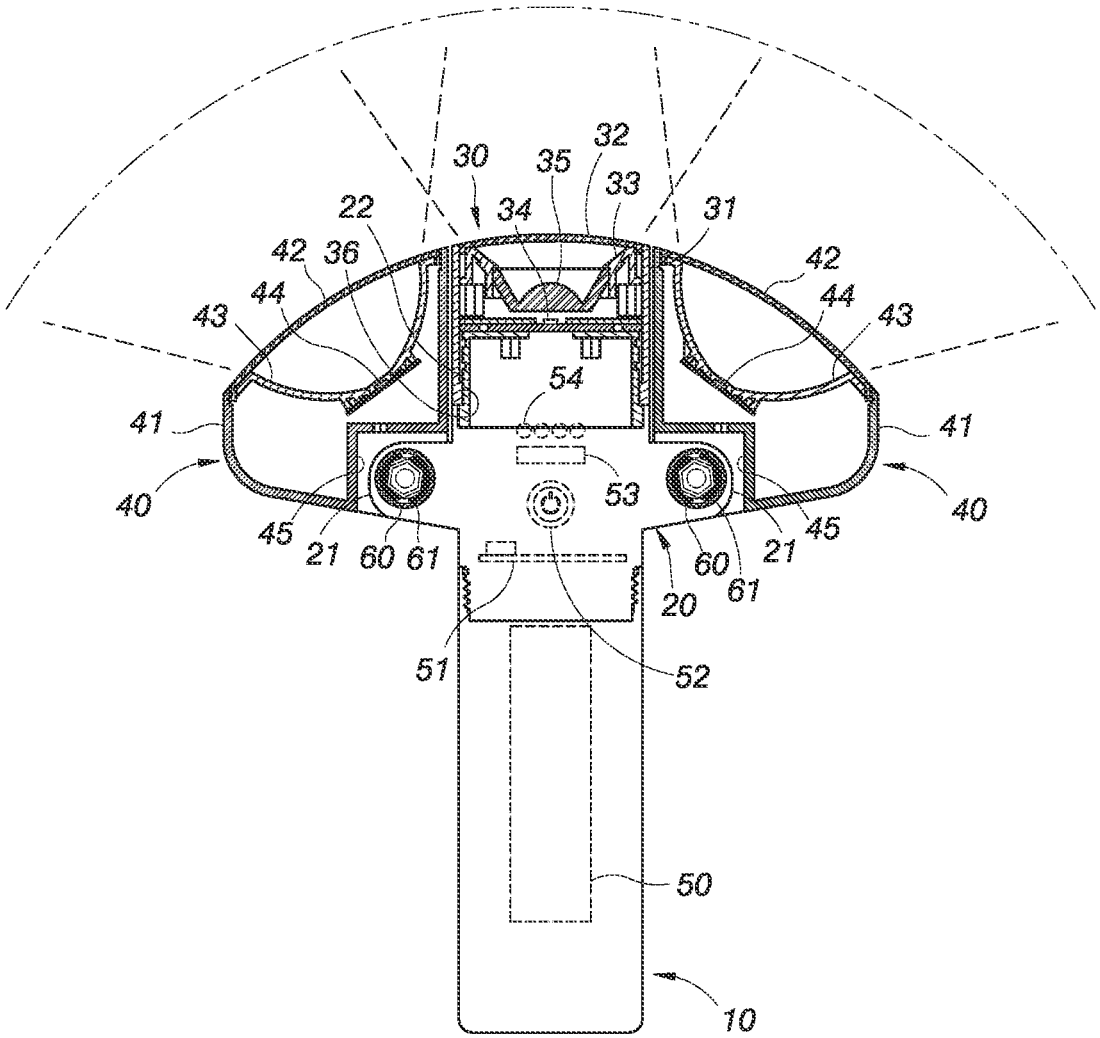
FIG. 6 is a schematic view of projecting light within a fan-shaped angle in accordance with the second embodiment of the present invention.
Figure 7:
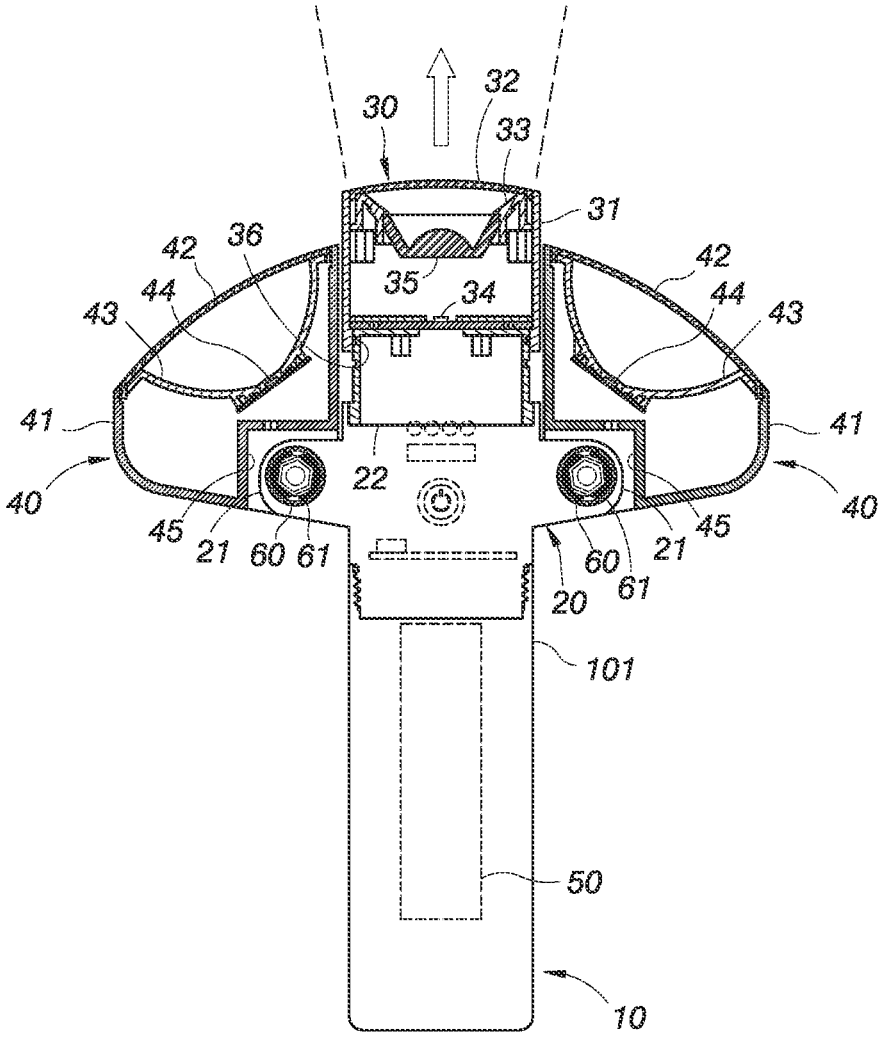
FIG. 7 is a schematic view of adjusting the focal length of lighting of a primary light in accordance with the present invention.

In an embodiment, the primary light 30 has a fixed focal length of lighting as shown in FIG. 3, or designed with a function of adjusting the focal length in a telescopic manner as shown in FIGS. 5-7, and its structure includes a positioning column 22 disposed at a front end 202 of the connection seat 20, and the first LED 34 of the primary light 30 is fixed to a front end surface 221 of the positioning column 22.

The first lamp housing 31 of the primary light 30 further has a convex lens 35 installed at the front of the first LED 34, and the first lamp housing 31 has a rear end 312 facing the rear, and the rear end 312 has a through hole 36 sheathed on the outer periphery of the positioning column 22, such that the first lamp housing 31 can be move back and forth relative to the positioning column 22, while allowing the convex lens 35 to displace with the first lamp housing 31 relative to the positioning column 22 and the first LED 34, so as to adjust the focal length of the first LED 34 to project light from the convex lens 35. When the light projection of the primary light 30 is at a farther distance, the secondary lights 40 on the two sides can cast light at a nearer distance, so that the surrounding and distant conditions can be seen clearly at the same time. Obviously, this disclosure provides a more convenience to use.

In addition, an embodiment of the battery 50 can adopt a general disposable battery or a rechargeable battery as shown in the figure. In the rechargeable battery, the bottom side of the connection seat 20 is provided with a charging interface 53 and a plurality of charging indicator lights 54, which are electrically connected to the circuit board 51, and the battery 50 can be charged through the charging interface 53. In an embodiment, the charging interface 53 is a USB interface (such as type-c) to facilitate plugging in a power supply device, and a dust cover that can be movably covered or opened is provided outside the USB (not shown in the figure).

While the invention has been described by means of specific embodiments, numerous modifications and variations could be made thereto by those skilled in the art without departing from the scope and spirit of the invention as set forth in the claims.

What is claimed is:

1. A fan-shaped flashlight with adjustable lighting angle, comprising:

a handle, provided for a user's grip, and having a front end, and a battery installed in the handle;

a connection seat, fixed to the front end of the handle, and having a top side, a front end configured to be facing the front, and two side ends disposed on two sides of the connection seat respectively, and the connection seat comprising a circuit board installed therein and electrically coupled to the battery, and a switch installed at the top side of the connection seat and electrically coupled to the circuit board;

a primary light, installed at the front end of the connection seat, and supplied with electric power by the circuit board to project light towards the front;

two secondary lights pivoted to two side ends of the connection seat respectively, and configured to be opposite to two sides of the primary light respectively, and supplied with electric power by the circuit board to project light towards the left front and the right front respectively;

wherein the primary light and the two secondary lights are arranged side by side on a same plane to project light within a fan-shaped angle, and the two secondary lights can be turned on the same plane and spread open towards the outside relative to the primary light to adjust the lighting angle and a position of the two secondary lights, and wherein the connection seat has a bottom side, and the bottom side has a charging interface and a plurality of charging indicator lights separately and electrically coupled to the circuit board.

2. The fan-shaped flashlight with adjustable lighting angle according to claim 1, wherein the primary light comprises a first lamp housing coupled to the connection seat, and the first lamp housing has a front edge facing the front, and the front edge of the first lamp housing comprises a first light-transmitting plate, a first reflector installed in the first lamp housing, and a first LED electrically coupled to the circuit board, and provided for projecting a light through the first reflector and the first light-transmitting plate towards the front; each secondary light comprises a second lamp housing pivoted to the connection seat, and the second lamp housing has a front edge facing the left front or the right front, and the front edge of the second lamp housing has a second light-transmitting plate, and the second lamp housing comprises a second reflector installed therein, and a second LED electrically coupled to the circuit board, and the two second reflectors and the two second LEDs configured to be facing the left front and the right front with an inclined angle relative to the first LED, and emitting a light through the corresponding second reflector and second light-transmitting plate and projecting the light towards the left front and the right front.

3. The fan-shaped flashlight with adjustable lighting angle according to claim 2, wherein the first light-transmitting plate has an outer contour substantially in an arc shape, and the two second light-transmitting plates have an outer contour substantially in an arc shape and corresponding to the first light-transmitting plate, and the first light-transmitting plate and the two second light-transmitting plates are combined into a continuous arc shape.

4. The fan-shaped flashlight with adjustable lighting angle according to claim 2, wherein, the two second lamp housings separately have a rear end facing the rear, and the rear end of each second lamp housing has a hinge slot, and two side ends of the connection seat have a hinge lug protruded therefrom and configured to be corresponsive to the two hinge slots separately, and the two hinge lugs are pivoted with the corresponding hinge slots respectively.

5. The fan-shaped flashlight with adjustable lighting angle according to claim 4, further comprising a plurality of positioning recesses formed between the two hinge slots of the two second lamp housings and the two hinge lugs of the connection seat respectively, and at least one elastic protrusion opposite to the plurality of positioning recesses, wherein after two second lamp housings are turned relative to the connection seat, the elastic protrusion can be snapped into any one positioning recess and positioned.

6. The fan-shaped flashlight with adjustable lighting angle according to claim 2, wherein the connection seat comprises a positioning column disposed at a front end thereof, and the first LED of the primary light is fixed to a front end surface of the positioning column; the first lamp housing of the primary light further comprises a convex lens installed at the front of the first LED, and the first lamp housing has a rear end facing the rear, and the rear end has a through hole, such that the first lamp housing can be movably sheathed on the outer periphery of the positioning column to allow the convex lens to displace together with the first lamp housing relative to the positioning column and first LED, so as to adjust the focal length of light projected by the first LED through the convex lens.

7. The fan-shaped flashlight with adjustable lighting angle according to claim 1, wherein the charging interface is of USB type-c.

8. The fan-shaped flashlight with adjustable lighting angle according to claim 1, wherein the two secondary lights are separately and outwardly turned and spread by approximate 90 degrees relative to the primary light.

* * * * *